US010103482B2

(12) United States Patent
Stuckmann

(10) Patent No.: US 10,103,482 B2
(45) Date of Patent: Oct. 16, 2018

(54) SPRING LOADED TERMINAL FOR CONDUCTORS

(71) Applicant: Weidmüller Interface GmbH & Co. KG, Detmold (DE)

(72) Inventor: Peter Stuckmann, Lage (DE)

(73) Assignee: Weidmüller Interface GmbH & Co. KG (DE)

( * ) Notice: Subject to any disclaimer, the term of this patent is extended or adjusted under 35 U.S.C. 154(b) by 0 days.

(21) Appl. No.: 15/604,861

(22) Filed: May 25, 2017

(65) Prior Publication Data

US 2017/0352980 A1 Dec. 7, 2017

(30) Foreign Application Priority Data

Jun. 2, 2016 (DE) ..... 20 2016 102 959 U

(51) Int. Cl.

| | |
|---|---|
| ***H01R 13/64*** | (2006.01) |
| ***H01R 13/627*** | (2006.01) |
| ***H01R 13/24*** | (2006.01) |
| ***H01R 25/00*** | (2006.01) |

(52) U.S. Cl.

CPC ..... *H01R 13/6272* (2013.01); *H01R 13/2428* (2013.01); *H01R 25/003* (2013.01)

(58) Field of Classification Search

CPC ..... H01R 13/6272; H01R 12/7005; H01R 13/64; H01R 13/642

USPC ..... 439/374

See application file for complete search history.

(56) References Cited

U.S. PATENT DOCUMENTS 4,416,500 A * 11/1983 Stenz ..... H01R 4/4872 439/436
5,915,991 A * 6/1999 Roman ..... H01R 4/4827 439/441
6,074,242 A * 6/2000 Stefaniu ..... H01R 4/4827 439/441

(Continued)

FOREIGN PATENT DOCUMENTS

DE 19817924 C2 4/1998
DE 202005010991 U1 11/2006

(Continued)

*Primary Examiner* — Tulsidas C Patel
*Assistant Examiner* — Peter G Leigh
(74) *Attorney, Agent, or Firm* — Laubscher & Laubscher, P.C.

(57) ABSTRACT

A spring loaded direct plug-in terminal with a direct plug-in connector for the connection of a conductor includes a housing with a chamber and a plug-in channel for plugging the conductor into the chamber. The terminal also includes a busbar, a clamping spring arranged in the chamber and acting as a compression spring for fixing the electrical conductor on the busbar in the area of a clamping site. The clamping spring includes a pivotable clamping arm which can be adjusted from a locked state in a locked position into a clamping state in which it is unlocked from the locked state and presses the electrical conductor against the busbar. An actuation element which is movable in the housing is provided which, together with the clamping arm of the clamping spring, can be locked in the locked state. The mobility of the actuation element in the housing in the locked state can be arrested by a locking element which is movable at an angle relative to the movement direction of the actuation element.

16 Claims, 5 Drawing Sheets

(56) References Cited

U.S. PATENT DOCUMENTS

| | | | | |
|---|---|---|---|---|
| 6,336,824 | B1 * | 1/2002 | Sorig | H01R 4/4836 439/395 |
| 6,783,385 | B2 * | 8/2004 | Rudy | H01R 4/4836 439/438 |
| 7,104,833 | B2 * | 9/2006 | Oesterhaus | H01R 4/4836 439/441 |
| 7,249,963 | B2 * | 7/2007 | Ramm | H01R 4/489 439/437 |
| 7,997,915 | B2 | 8/2011 | Pueschner et al. | |
| 8,998,634 | B2 * | 4/2015 | Koellmann | H01R 9/26 439/441 |
| 9,083,115 | B2 * | 7/2015 | Hoppmann | H01R 4/4827 |
| 9,331,427 | B2 * | 5/2016 | Tedeschi | H01R 13/629 |
| 9,601,844 | B2 | 3/2017 | Gassauer et al. | |
| 2009/0104816 | A1 | 4/2009 | Koelmann | |

FOREIGN PATENT DOCUMENTS

| | | | | |
|---|---|---|---|---|
| DE | 102007050683 | A1 | 4/2009 | |
| DE | 202011050916 | U1 | 11/2012 | |
| DE | 102011115637 | A1 | 12/2012 | |
| DE | 202014103797 | U1 | 11/2014 | |
| DE | 102013109640 | A1 | 3/2015 | |
| EP | 2843764 | A1 * | 3/2015 | H01R 4/4845 |

* cited by examiner

SPRING LOADED TERMINAL FOR CONDUCTORS

This application claims priority of German patent application No. DE 202016102959.7 filed Jun. 2, 2016 which is incorporated herein by reference.

BACKGROUND OF THE INVENTION

The present invention relates to a spring loaded terminal.

Spring loaded terminals in the form of direct plug-in or push-in terminals with a clamping spring designed as a compression spring which presses a conductor against a busbar are known in the prior art. They differ based on the use thereof as a function of the needed current carrying capacity of the busbar, on the spring force of the clamping spring and/or on the installation conditions and on the size thereof. Simple installation and cost effective manufacture are requirements that are always applicable to such terminals.

U.S. Pat. No. 7,997,915 B2 discloses a connector on the end of which that faces away from the pin terminal is arranged a direct plug-in terminal for the non-detachable connection of an electrical conductor. The direct plug-in terminal includes a current carrying clamping cage for electrical contact with the electrical conductor and a spring for the electrical conductor. The spring has a pivotable clamping arm which, when an electrical conductor is not introduced into the direct plug-in terminal, is positioned on a holding edge of a holding spring, so that a free space is kept clear for the electrical conductor so that the conductor can be introduced into the clamping cage. When the direct plug-in terminal is introduced, an arm of the holding spring is shifted in such a manner that the clamping arm is released and is pivoted. The pivoted clamping arm presses the electrical conductor against the clamping cage.

SUMMARY OF THE INVENTION

The present invention was developed to produce a spring loaded terminal, in particular a stackable spring loaded terminal for stranded conductors, which improves this functionality and which is also usable for stranded conductors with a small cross section.

A spring loaded terminal—designed in particular in the form of a direct plug-in terminal with a direct plug-in connector—is produced for connection of a conductor which can be designed as a flexible stranded conductor. The terminal includes a housing with a chamber and a plug-in channel for plugging the conductor into the chamber, a busbar, and a clamping spring which is arranged in the chamber and acts as compression spring for fixing the electrical conductor on the busbar in the area of a clamping site. The clamping spring includes a pivotable clamping arm which can be adjusted from a locked state in which it is locked in a locked position into a clamping state in which it is unlocked from the locked state and presses the electrical conductor against the busbar. An actuation element which is movable in the housing is provided and which together with the clamping arm of the clamping spring can be locked in the locked state. Movement of the actuation element in the housing in the locked state can be barred by a locking element that can be moved at an angle relative to the movement direction of the actuation element. In this manner, not only is the clamping spring locked but so is the actuation element. This makes it possible to arrange the locking element in the housing and accessible outside of the housing in such a manner that it is easy to reach directly by hand and/or with a tool such as a screwdriver in order to release the locking element from the locked position. A manual release includes a corresponding contour that can be gripped manually, such as a protrusion on the locking element, is manually accessible from outside.

A metal spring which directly latches or locks a free end of the clamping arm such as in the prior art devices is thus unnecessary. In this manner, damage to the clamping arm is also prevented.

Preferably, the actuation element is designed in a structurally simple manner as a actuation device for moving the clamping arm which is movable in an actuation channel of the housing in the plug-in direction. Movement of the clamping arm in the actuation channel can be locked and released by moving the locking element at an oblique angle relative to the actuation channel. In this manner, the invention can be implemented in a simple and reliable manner.

According to a preferred embodiment, the locking element includes a spring element. In this manner, the locking element can automatically be moved by the spring action into a latching position or locking position in which it prevents movement of the actuation device and results in the locked position of the clamping arm. This spring element in turn is designed to move the locking element in a locking channel at an oblique angle into the actuation channel.

Preferably, the spring element is designed in such a manner that a spring force can be generated under which the head automatically can be pulled or shifted from the locking channel into the actuation channel when the actuation device is pushed down sufficiently into the actuation channel that the head of the locking element can move into the actuation channel. In this manner, the handling of the spring loaded connector is relatively simple.

The locking element can be moved back manually preferably by an actuation tool such as a screwdriver in the locking channel at an angle relative to the conductor plug-in direction, so that the actuation device is released which in turn releases the clamping arm of the clamping spring so that the clamping arm is released from the locked position and is relaxed. For this purpose, the locking element includes an actuation contour on which a tool can be set.

The spring loaded terminal is suitable not only for solid wires, but also for stranded conductors. A stranded conductor can be moved back and forth without splaying of the strands in the locked state in the free space of the chamber in the housing. It is possible to select a material for the busbar which has good electrical conductivity, for example, copper or a copper alloy. For the clamping spring, steel is a suitable manufacturing material.

In this manner, it is possible to produce a pin or socket strip with several stacked spring loaded terminals. However, with one or more of such spring loaded terminals, it is also possible to produce terminal blocks. In addition, the spring loaded terminal can also be used in other types of housings.

BRIEF DESCRIPTION OF THE FIGURES

Other objects and advantages of the invention will become apparent from a study of the following description when viewed in the light of the accompanying drawing, in which.

DETAILED DESCRIPTION

Figure 1B:
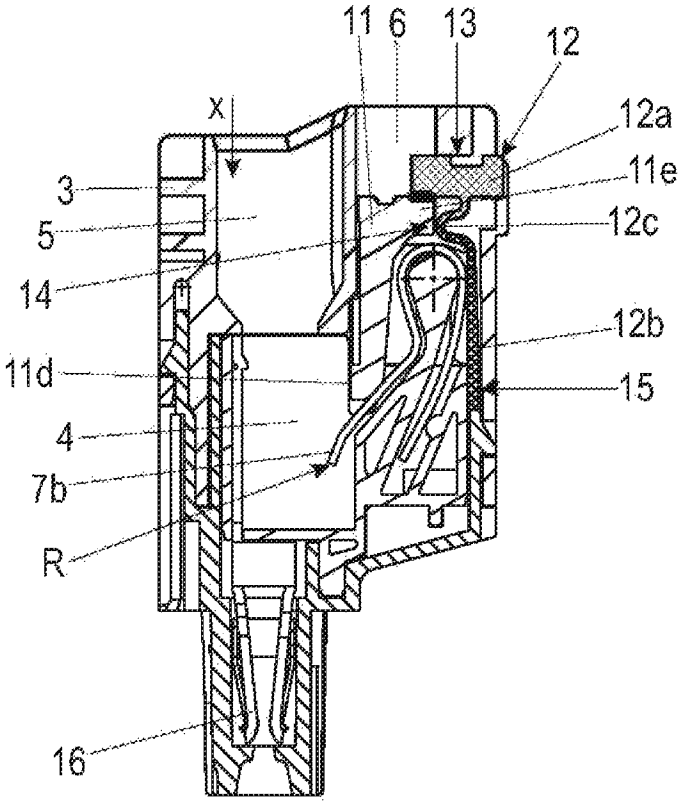
FIG. 1*b* is a cross-sectional view of the spring loaded terminal from FIG. 1*a* with the clamping arm in the locked state.
Figure 1A:
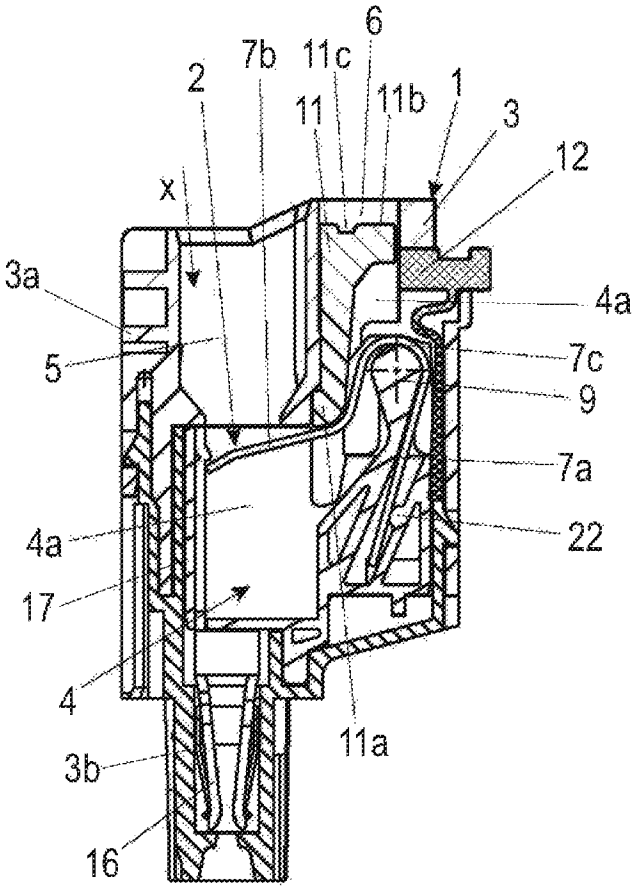
FIG. 1*a* is a cross-sectional view of a spring loaded terminal with a clamping arm for clamping an electrical conductor which is introduced into the spring loaded terminal in a non-locked state of a clamping arm.
Figure 1D:
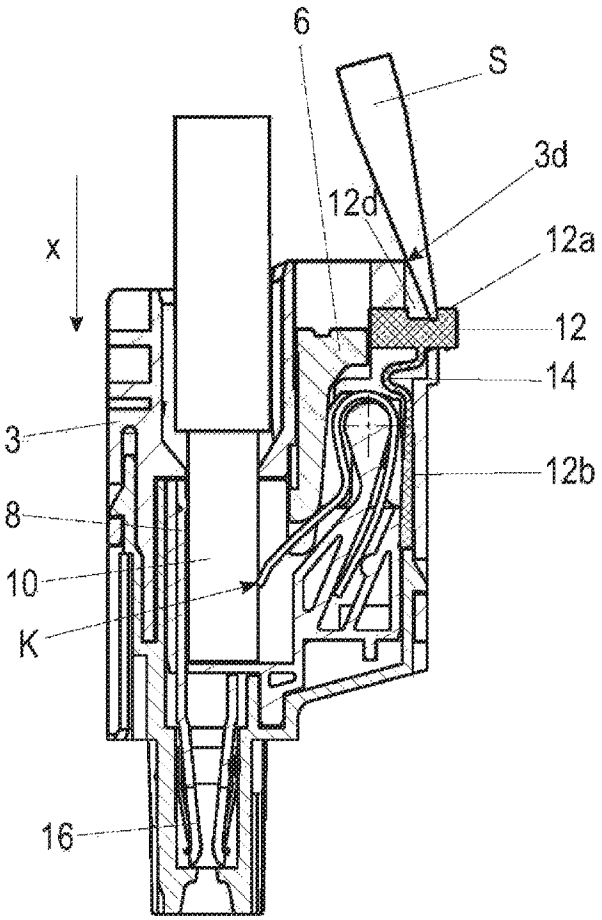
FIG. 1*d* is a cross-sectional view of the spring loaded terminal from FIG. 1*c* with the clamping arm released from the locked state in contact with the conductor.
Figure 1C:
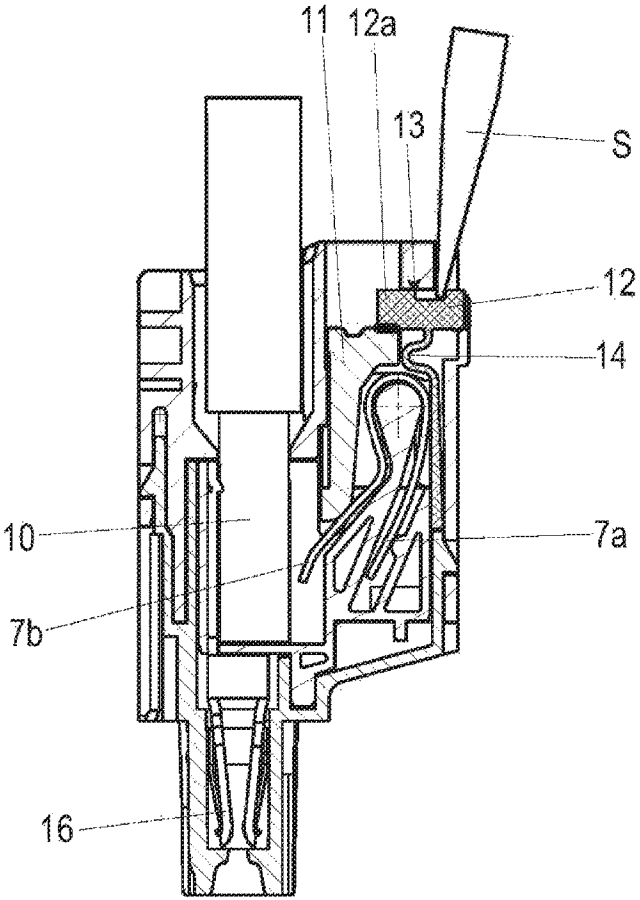
FIG. 1*c* is a cross-sectional view of the spring loaded terminal from FIG. 1*b* with a conductor introduced into an area of a clamping site during release of the locked state of the clamping arm.
Figure 1F:
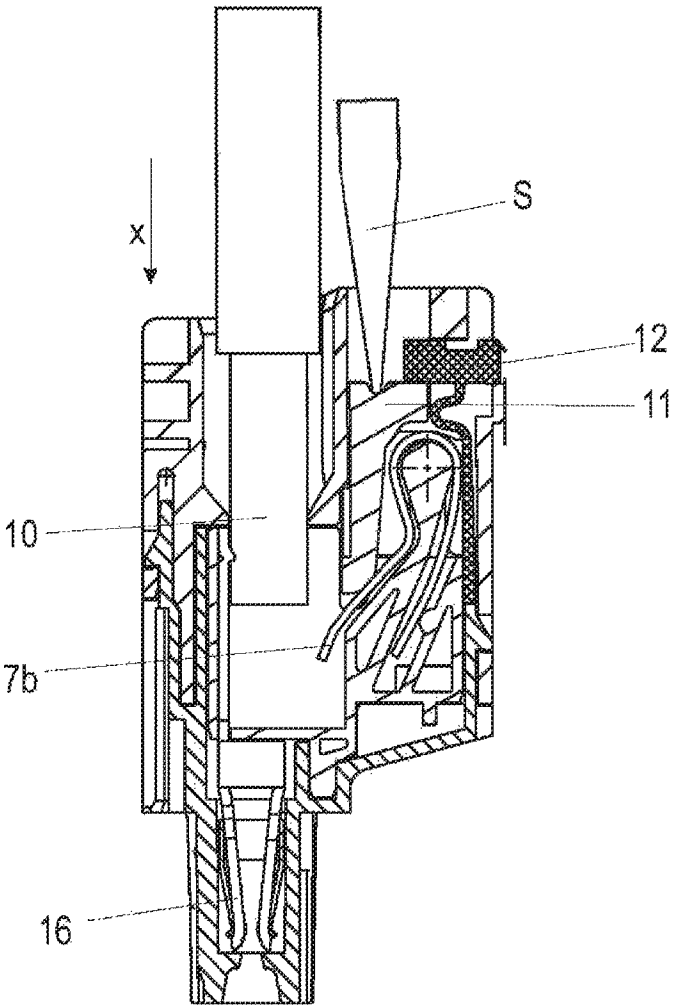
FIG. 1*f* is a cross-sectional view of the spring loaded terminal from FIG. 1*e* after the opening of the clamping site by pushing down of the actuation device during the removal of the conductor from the clamping site.
Figure 1E:
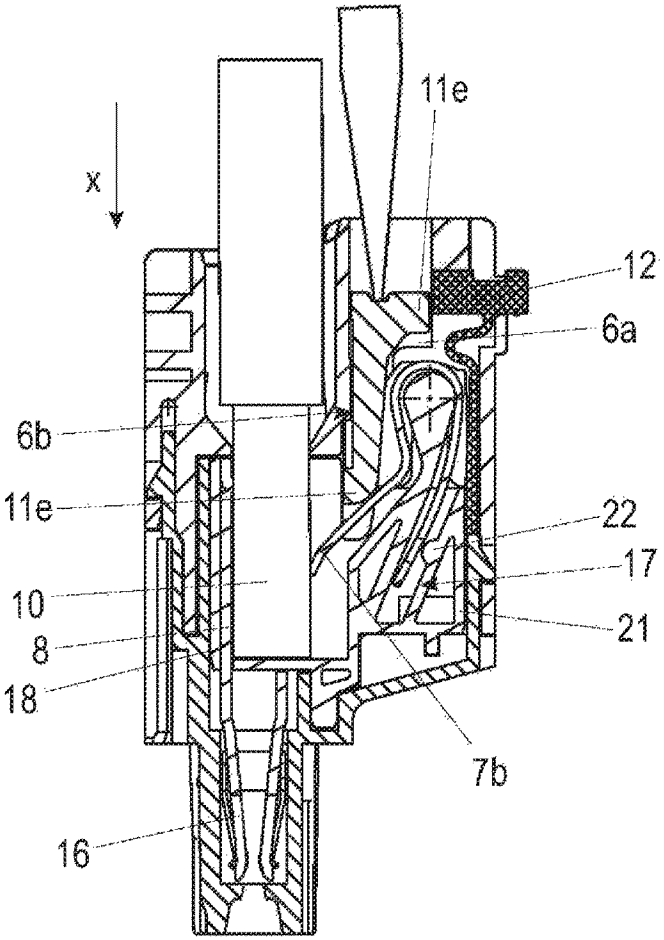
FIG. 1*e* is a cross-sectional view of the spring loaded terminal from FIG. 1*d* during opening of the clamping site by pushing down an actuation element in the form of a actuation device.
Figure 2B:
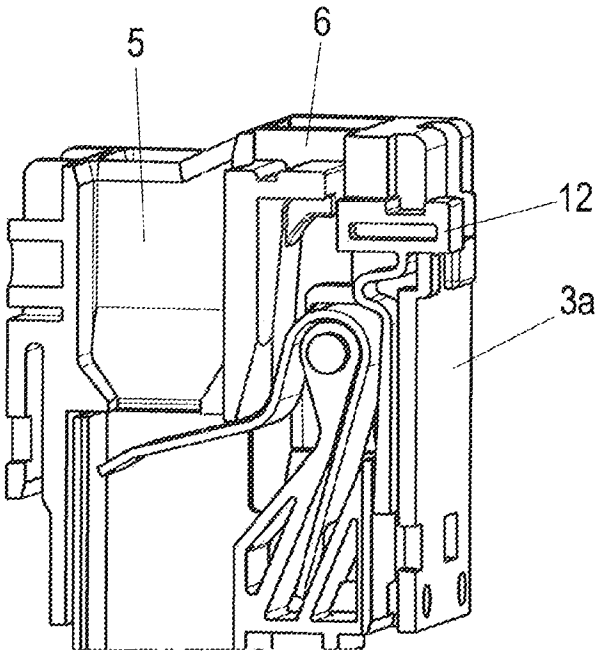
FIG. 2*b* is a perspective view of the spring loaded terminal from FIG. 2*a* after releasing the locked state of the clamping arm without a conductor being shown.

FIG. 1 and FIG. 2 each show a respective spring loaded terminal 1 of identical design with a direct plug-in connector 2 which is arranged in a single-part or preferably a multi-part housing 3. The spring loaded terminal 1 is shown in each case in a stackable design. This means that perpendicularly to the image plane in one or more housings 3, one or more of the direct plug-in connectors 2 can be formed one after the other, for example, in the manner of a multipolar connection strip such as shown in FIG. 3.

The single-part or multi-part housing 3 are formed of an insulating plastic. The housing 3 has a housing upper portion 3*a* and a housing lower portion 3*b* which are locked together.

In the housing lower portion 3*b*, a chamber 4 or several chambers 4 are formed.

Figure 3:
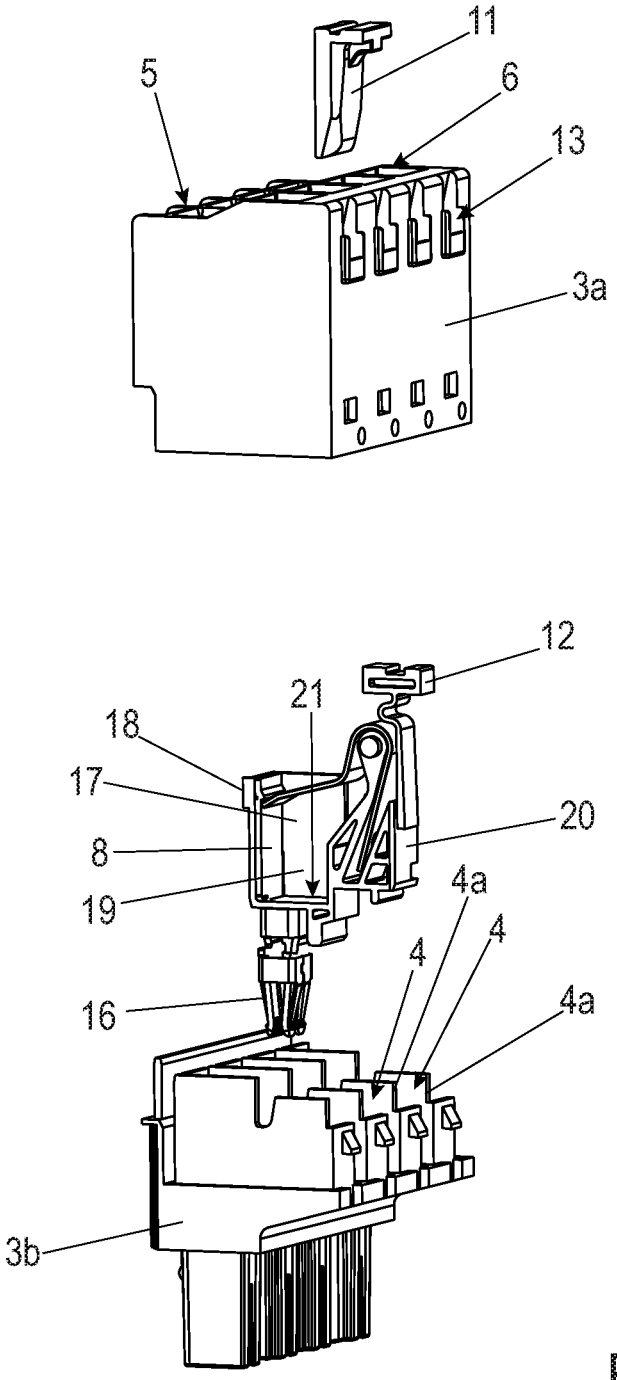
FIG. 3 is an exploded perspective view of a connection strip with several spring loaded terminals.

As shown in FIG. 3, the chambers 4 are separated from one another by a respective wall 4*a*. In the multipolar design, several chambers 4 are formed one after the other in the housing 3 perpendicularly to the image plane of FIG. 1*a*, in each of which one of the direct plug-in connectors 2 is formed.

The chamber 4 is connected by a conductor plug-in channel 5 to one of the outside surfaces of the housing—referred to as "plug-in side"—and by an actuation channel 6. The conductor plug-in channel 5 and the actuation channel 6 are formed in the housing upper portion 3*a*. The actuation channel 6 extends substantially parallel to the conductor plug-in channel 5. The actuation channel 6 is stepped as shown in FIG. 1*a*.

In the chamber 4, for the formation of the direct plug-in connector 2, at least one clamping spring 7 and a busbar 8 are arranged. Optionally, an insert 17 made of plastic or a clamping cage made of metal can be provided which is used for supporting the clamping spring 7 and the busbar 8. In a cost-effective and space-saving design, no metal clamping cage is provided, but instead the insert 17 is provided for ease of installation.

The insert 17 is inserted into the chamber 4 in the housing lower portion 3*b*. The insert 17 acts as a clamping cage. It is U-shaped in top view. In the downward direction, it includes a perforation 21 for inserting the busbar 8, which abuts against one of the walls 18, 19, 20 of the insert 17 which is U-shaped in a top view from above. The insert 17 is formed of non-conductive plastic.

Support of the clamping spring 7 and the busbar 8 can also be provided by walls of the chamber 4 of the housing 2 such as a terminal block which is open on one side for locking on a busbar.

It should be noted that the busbar 8 is connected to a second connector 16 or designed as a single part. This connector is designed as a spring connector in the form of a socket contact and it enables an external conductor or plug to be plugged into the housing 3. The connector can also be designed as a pin or blade connector.

The clamping spring 7 is U-shaped or V-shaped and includes a supporting arm 7*a* and a clamping arm 7*b*. The supporting arm 7*a* is supported against an abutment. The abutment is formed by a ridge 22 of the insert 17 as shown in FIG. 1*e*.

The clamping arm 7*b* is connected via an arched back 7*c* to the supporting arm 7*a*. The back 7*c* extends over a supporting contour 9 of the insert 17 which protrudes into the chamber 4. This supporting contour 9 is designed to be semi-cylindrical towards the back 7*c* and, moreover, it also forms an abutment for limiting the movement of the clamping arm 7*b*.

The clamping arm 7*b* is used to press the end of a conductor 10 against the busbar 8. In this manner, an electrically conductive contact is established between the conductor 10 in the area of the clamping site K as shown in FIG. 1*d*.

The conductor 10 is led in a conductor plug-in direction X through the conductor plug-in channel 5 into the chamber 4 in the area of the clamping site K.

In the actuation channel 6, an actuation element for moving the clamping arm 7*b* is arranged. The actuation element is designed in the form of a push element or actuation device 11 which is slidably led in the actuation channel 6.

The actuation device 11, with an end 11*a* thereof which is designed as a push contour, rests on the clamping arm 7*b*. By pressing against the end 11*b* located away from the clamping arm 7*b*, a force can be exerted in the plug-in direction X on the clamping arm 7*b*, in order to move the actuation device 11 in plug-in direction and thus also move or pivot the clamping arm 7*b* and in order to open the clamping site K.

The end 11*b* of the actuation device 11 facing away from the clamping arm 7*b* has an actuation contour 11*c* in the form of a recess or a slot for receiving a tool such as a screwdriver S as shown in FIGS. 1*c* and 1*d*.

On the ends 11*a*, 11*b* of the actuation device 11, ledges or protrusions 11*d*, 11*e* are provided, which cooperate with edges 6*a*, 6*b* or steps of the actuation channel 6 and which limit the movement of the actuation device 11 in the plug-in channel in and opposite to the plug-in direction.

A locking element 12 is associated with the actuation device 11. When the actuation device 11 is pushed down sufficiently into the actuation channel 6, the clamping site K is opened and a conductor 10 can be introduced into the clamping site and fixed by the locking element as shown in FIGS. 1*a* and 1*b*.

For this purpose, a locking channel 13 is provided in the housing upper portion at an oblique angle relative to the actuation channel 6. The locking channel leads into the actuation channel 6 and directs the locking element 12 in a sliding manner.

Figure 2A:
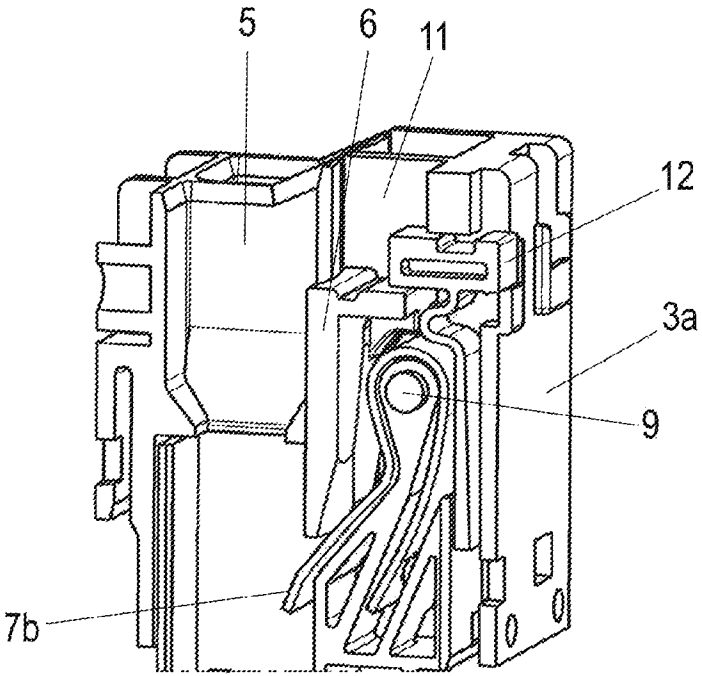
FIG. 2*a* is a perspective view of a section of a spring loaded terminal of the type of FIG. 1 with a clamping arm in the locked state without a busbar being shown.

After the actuation device 11 is pushed downward, the locking element 12 in the locking channel 13 can be moved into a position in which the locking element 12 locks the position of the actuation device 11 and thus the lock open position of the clamping arm 7*b*. FIG. 2*a* shows in cross section a disk-shaped section of the housing upper portion 3*a*. FIG. 3 shows an outside view of the housing upper portion 3*a*.

In a preferred embodiment, this movement occurs automatically due to a spring element 14. This spring element 14 is designed to form a single piece with the locking element 12. However, a separate spring can also be associated with the locking element 12.

The locking element 12 includes a head 12*a* made of plastic and a spring arm 12*b* which is like a leaf-spring at least in sections and which is designed to form a single piece with the head. The spring arm 12*b* has a bend 12*c* and in this manner forms the spring element 14. The spring arm 12*b* is supported in the housing 3 in a slot 15 parallel to the supporting arm 7*a* of the clamping spring 7.

The spring element 14 is designed such that a spring force is generated by which the head 12*a* is pulled automatically in the locking channel 13 into the actuation channel 6, when the actuation device 11 in the actuation channel 6 has been pushed down sufficiently far that the head 12*a* of the locking element 12 can move freely into the actuation channel 6. The spring 14 engages the locking element 12 in a springy manner that, after the actuation device 11 has been pushed down sufficiently, the head 12*a* of the locking element 12 is moved laterally in the locking channel 13 to the point that it sinks at an oblique angle into the actuation channel 6 and prevents backward movement of the actuation device 11 against the conductor introduction direction X.

Since the locking element 12 locks the position of the actuation device 11 and thus the lock open position of the clamping arm 7*b*, the insulated end of the conductor 10 can now be led in the conductor plug-in direction X in the conductor introduction channel 5 into the clamping site K as shown in FIG. 1*c*.

The locking element 12 is also used to unlock the locked position of the actuation device 11 or of the clamping arm 7*b*. The locking element 12 is manually moved backwards, preferably using an actuation tool such as a screwdriver S, in the locking channel 13 perpendicularly to the conductor plug-in direction X, so that the actuation device 11 is released, which in turn releases the clamping arm 7*b* of the clamping spring 7, so that the latter can be relaxed. As a result, the conductor 10 is pressed against the busbar 8 and electrically contacted in the area of the clamping site K as shown in FIG. 1*d*. The actuation device 11 moves back in the actuation channel 6 into an upper position, in which it is located axially in front of the locking channel 13.

The locking element 12 preferably has an actuation contour 12*d* such as a slot on the head 12*a* on which a tool such as the screwdriver S can be set. The screwdriver S can thus be used as a pivotable lever arm to interact with an edge 3*b* of the housing 3 to move the locking element 12 laterally in the cross channel 15, so that the locked positions of the actuation device 11 and of the clamping arm 7*b* are released as shown in FIG. 1*d*. The clamping arm 7*b* relaxes and is moved/pivoted in direction of the clamping site K.

The housing 3 is designed so that in another channel or laterally on the housing 3, the slot 12*d* can be reached with the screwdriver S. The screwdriver S is arranged in the slot 12*d* to be able to move the locking element 12 laterally in the locking channel 13 by pivoting the screwdriver S in order to release the locked position of the actuation device 11 and of the clamping arm 7*b* of the clamping spring 7.

While the preferred forms and embodiments of the invention have been illustrated and described, it will be apparent to those of ordinary skill in the art that various changes and modifications may be made without deviating from the inventive concepts set forth above.

The invention claimed is:

1. A spring loaded terminal for electrical connection with a conductor, comprising (a) a housing containing a chamber, a plug-in channel for plugging the conductor within said chamber, an actuation channel, and a locking channel arranged at an angle relative to said actuation channel;

(b) a busbar arranged within said housing adjacent to said chamber;

(c) a clamping spring arranged within said chamber for connecting the conductor with said busbar within a clamping region of said chamber, said clamping spring including a clamping arm which pivots from a locked position to a clamping positing in which said clamping arm biases the conductor against said busbar;

(d) an actuation device movable within said housing in a first direction for locking said clamping arm in the locked position;

(e) a locking device movable within said locking channel at an angle relative to said first direction into said actuation channel for preventing movement of said actuation device when it is the locked position; and (d) a spring element independent of said locking device for moving said locking device within said locking channel.

2. The spring loaded terminal as defined in claim 1, wherein said locking device includes a head portion and a spring arm.

3. The spring loaded terminal as defined in claim 2, wherein said locking device spring arm is integral with said head portion.

4. A spring loaded terminal for electrical connection with a conductor, comprising (a) a housing containing a chamber, a plug-in channel for plugging the conductor within said chamber, an actuation channel, and a locking channel arranged at an angle relative to said actuation channel;

(b) a busbar arranged within said housing adjacent to said chamber;

(c) a clamping spring arranged within said chamber for connecting the conductor with said busbar within a clamping region of said chamber, said clamping spring including a clamping arm which pivots from a locked position to a clamping position in which said clamping arm biases conductor against said busbar;

(d) an actuation device movable within said actuation channel in a first direction for locking said clamping arm in the locked position; and (e) a locking device including a head portion and a spring arm, said locking device head portion being movable at an angle relative to said first direction within said actuation channel for preventing movement of said actuation device when it is in the locked position, wherein said housing contains a slot beneath said locking channel, said locking device spring arm being arranged in said slot, and further wherein said locking device contains a bend between said head portion and said spring arm, said bend defining a spring element which displaces said locking device within said locking channel.

5. The spring loaded terminal as defined in claim 4, wherein said locking device spring arm and bend bias said head portion toward said actuation channel, whereby when said actuation device is displaced within said actuation channel beyond said locking device head portion, said locking device head portion moves into said actuation channel to lock said actuation device in the locked position.

6. The spring loaded terminal as defined in claim 5, wherein said locking device head portion is manually displaceable within said locking channel against the bias force of the spring to release said actuation device from the locked position.

7. The spring loaded terminal as defined in claim 6, wherein said locking device head portion is configured to receive a tool to manually displace said head portion within said licking channel against the bias force.

8. The spring loaded terminal as defined in claim 4, wherein said housing chamber contains an insert for supporting said clamping spring and said bulbar.

9. A spring loaded terminal for electrical connection with a conductor, comprising (a) a housing containing a chamber which contains an insert and a plug-in channel for plugging the conductor within said chamber;

(b) a busbar arranged within said housing adjacent to said chamber and supported by said insert;

(c) a clamping spring arranged within said chamber and supported by said insert for connecting the conductor with said busbar within a clamping region of said chamber, said clamping spring including a clamping arm which pivots from a locked position to a clamping position in which said clamping arm biases the conductor against said busbar;

(d) an actuation device movable within said housing in a first direction for locking said clamping arm in the locked position; and (e) a locking device movable at an angle relative to said first direction for preventing movement of said actuation device when it is in the locked position wherein said housing includes an upper portion containing said chamber, said clamping spring, said actuation device, said locking device, and said busbar and a lower portion containing a further connector.

10. The spring loaded terminal as defined in claim 9, wherein said housing contains an actuation channel within which said actuation device moves in said first direction, said locking device being movable at an oblique angle within said actuation channel to lock said actuation device in the locked position.

11. The spring loaded terminal as defined in claim 10, where said locking device comprises a spring element.

12. The spring loaded terminal as defined in claim 11, wherein housing contains a locking channel arranged at an oblique angle relative to said actuation channel, said spring element displacing said locking device within said locking channel.

13. The spring loaded terminal as defined in claim 12, wherein said spring element displaces said locking device into said actuation channel to lock said actuation device in the locked position.

14. The spring loaded terminal as defined in claim 9, wherein said actuation channel extends parallel to said plug-in channel.

15. The spring loaded terminal as defined in claim 9, wherein said busbar is electrically connected with a further connector for connection with at least one of a further conductor and plug.

16. A socket strip comprising a plurality of spring loaded terminals as defined in claim 9, connected in stacked relation.

* * * * *